US011421354B2

(12) United States Patent
Lee et al.

(10) Patent No.: US 11,421,354 B2
(45) Date of Patent: Aug. 23, 2022

(54) FLAT KNITTING MACHINE YARN FEEDER WITH VARIABLE YARN FEEDING POSITIONS

(71) Applicant: PAI LUNG MACHINERY MILL CO., LTD., New Taipei (TW)

(72) Inventors: Chih-Chiang Lee, New Taipei (TW); Yuo-Po Cheng, New Taipei (TW)

(73) Assignee: PAI LUNG MACHINERY MILL CO., LTD., New Taipei (TW)

( * ) Notice: Subject to any disclaimer, the term of this patent is extended or adjusted under 35 U.S.C. 154(b) by 158 days.

(21) Appl. No.: 16/287,386

(22) Filed: Feb. 27, 2019

(65) Prior Publication Data

US 2020/0270782 A1 Aug. 27, 2020

(51) Int. Cl.
*D04B 15/56* (2006.01)
*D04B 15/48* (2006.01)
*D04B 23/22* (2006.01)

(52) U.S. Cl.
CPC ..... *D04B 15/56* (2013.01); *D04B 15/48* (2013.01); *D04B 23/22* (2013.01)

(58) Field of Classification Search
CPC ..... D04B 15/48; D04B 15/54; D04B 15/56; D04B 23/22
See application file for complete search history.

(56) References Cited

U.S. PATENT DOCUMENTS

2004/0211224 A1* 10/2004 Miyamoto ..... D04B 15/56 66/126 R
2006/0144096 A1* 7/2006 Okuno ..... D04B 1/123 66/127
2008/0302137 A1* 12/2008 Miyamoto ..... D04B 7/26 66/127
2013/0067965 A1* 3/2013 Lin ..... D04B 15/56 66/126 R
2013/0145652 A1* 6/2013 Podhajny ..... A43B 23/0255 36/50.1
2013/0212907 A1* 8/2013 Dua ..... A43B 9/00 36/83
2017/0370035 A1* 12/2017 Lonati et al. ..... D04B 15/58
2018/0282916 A1* 10/2018 Dealey ..... D04B 15/48

FOREIGN PATENT DOCUMENTS

DE 2459693 A1 * 6/1975 ..... D04B 7/26
EP 2570537 A1 * 3/2013 ..... D04B 15/56
WO WO-2006056843 A1 * 6/2006 ..... D04B 15/96

* cited by examiner

*Primary Examiner* — Megan E Lynch
(74) *Attorney, Agent, or Firm* — Muncy, Geissler, Olds & Lowe, P.C.

(57) ABSTRACT

A flat knitting machine yarn feeder with variable yarn feeding positions is provided. The flat knitting machine yarn feeder includes a driving mechanism and a yarn feeding mechanism. The driving mechanism is controlled by an electronic signal and includes a driving plate which makes a push stroke after started. The yarn feeding mechanism comprises a joining plate connected with the driving plate and a yarn feeding arm assembled with the joining plate. The joining plate comprises a guide hole. The yarn feeding arm comprises a guide column disposed in the guide hole. The joining plate makes a displacement stroke when the driving plate makes the push stroke. The guide column changes a position in the guide hole when the joining plate makes the displacement stroke. The yarn feeding arm changes a yarn feeding position when the guide column changes the position.

2 Claims, 4 Drawing Sheets

FLAT KNITTING MACHINE YARN FEEDER WITH VARIABLE YARN FEEDING POSITIONS

FIELD OF THE INVENTION

The present invention relates to a flat knitting machine yarn feeder, in particular to a flat knitting machine yarn feeder with variable yarn feeding positions.

BACKGROUND OF THE INVENTION

The yarn feeding structure of the current flat knitting machine is unable to change the yarn feeding position after set, which occurs the situation that the position of a plated loop may be wrong since the yarn feeding position is unable to be duly changed according to the knitting conditions in the knitting process.

SUMMARY OF THE INVENTION

The main purpose of the present invention is to solve the problem that the yarn feeding position cannot be changed in the knitting process after the yarn feeding structure of the flat knitting machine is set.

To achieve the above purpose, the present invention provides a flat knitting machine yarn feeder with variable yarn feeding positions. The flat knitting machine yarn feeder includes a driving mechanism and a yarn feeding mechanism, wherein the driving mechanism is controlled by an electronic signal and includes a driving plate which makes a push stroke after started. The yarn feeding mechanism comprises a joining plate connected with the driving plate and a yarn feeding arm assembled with the joining plate. The joining plate comprises a guide hole. The yarn feeding arm comprises a guide column disposed in the guide hole. The joining plate makes a displacement stroke when the driving plate makes the push stroke. The yarn feeding arm comprises a yarn feeding end facing a needle bed. The guide column changes a position in the guide hole when the joining plate makes the displacement stroke. The yarn feeding arm changes a yarn feeding position of the yarn feeding end relative to the needle bed when the guide column changes the position.

In an embodiment, the guide hole comprises two bevels which are disposed oppositely and contacted with the guide column; the two bevels are positioned in a motion direction of the flat knitting machine yarn feeder, the yarn feeding position is changed when the guide column changes the position of one of the bevels. Further, the guide hole is trapezoidal.

In an embodiment, the driving plate comprises a bump which is disposed at an end and protrudes towards the joining plate; and the joining plate comprises a supporting rail to provide the bump for disposal.

In an embodiment, the yarn feeding mechanism includes a combining element assembled with a yarn feeder guide rod, and the combining element includes a plurality of limiting columns respectively disposed to correspond to the joining plate and the yarn feeding arm to limit the joining plate and the yarn feeding arm to only make one-dimensional motion.

As previously described in the present invention, compared with the prior art, the present invention comprises the following characteristics: the flat knitting machine yarn feeder of the present invention changes the yarn feeding position of the flat knitting machine in the knitting process, so as to reduce the problem that the yarn feeding position may be wrong.

DETAILED DESCRIPTION OF THE PREFERRED EMBODIMENTS

Figure 1:
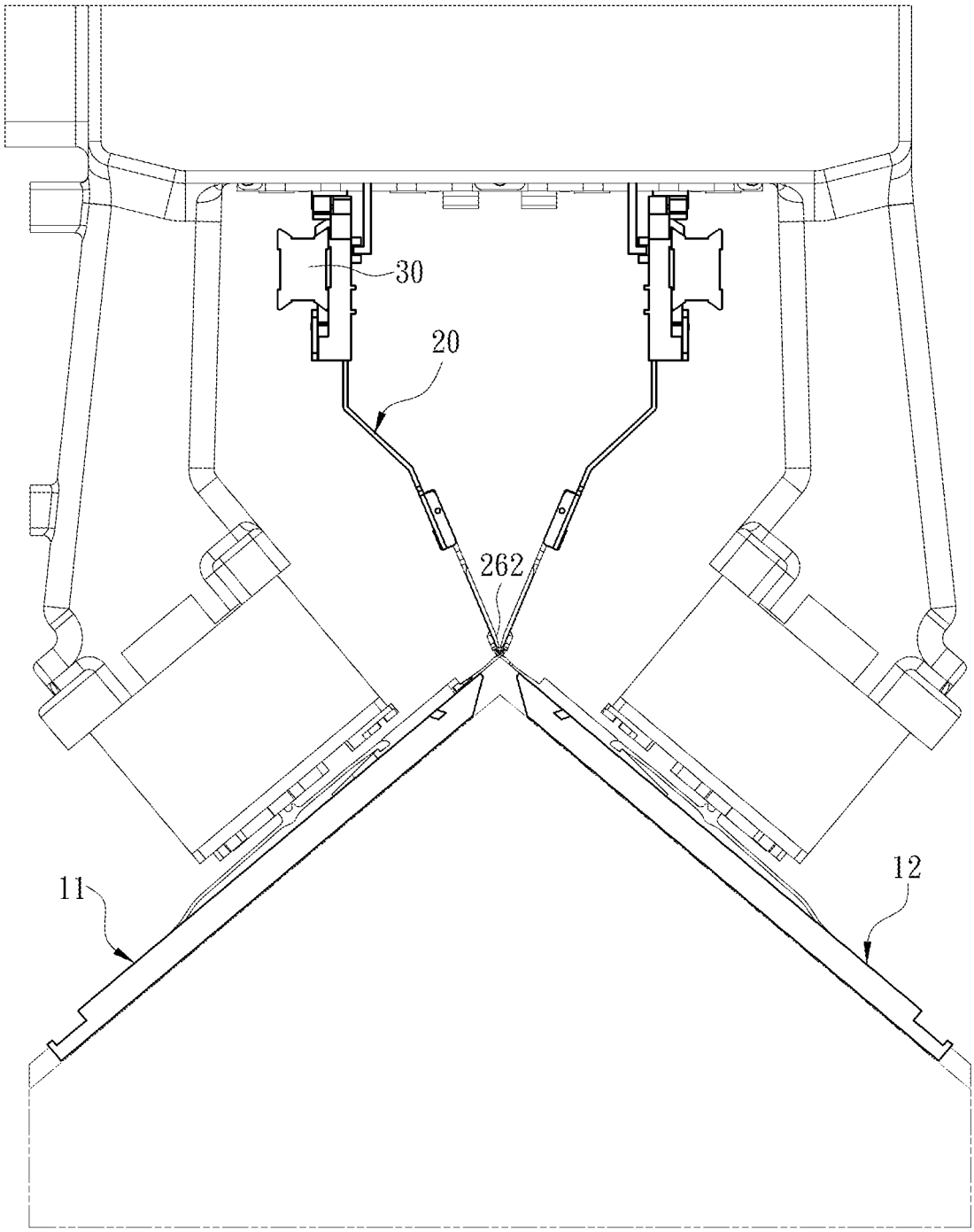
FIG. 1 is a structural schematic diagram of a flat knitting machine in an embodiment of the present invention.

The details and technical contents of the present invention will be described below with reference to drawings.

Referring to FIGS. 1, 2, 3 and 4, the present invention proposes a flat knitting machine yarn feeder 20 with variable yarn feeding positions. An operation position of the flat knitting machine yarn feeder 20 in a flat knitting machine 100 is corresponding to a region defined by the middle of two needle beds 11 and 12. Moreover, the flat knitting machine yarn feeder 20 of the present invention includes a driving mechanism 21 and a yarn feeding mechanism 22. The driving mechanism 21 comprises a motor 23 and a driving plate 24 connected with the motor 23. The motor 23 is controlled by an electronic signal and accepts the electronic signal when the knitting conditions of the flat knitting machine 100 are changed. Furthermore, the driving plate 24 is driven by the motor 23 to make one-dimensional motion.

Figure 2:
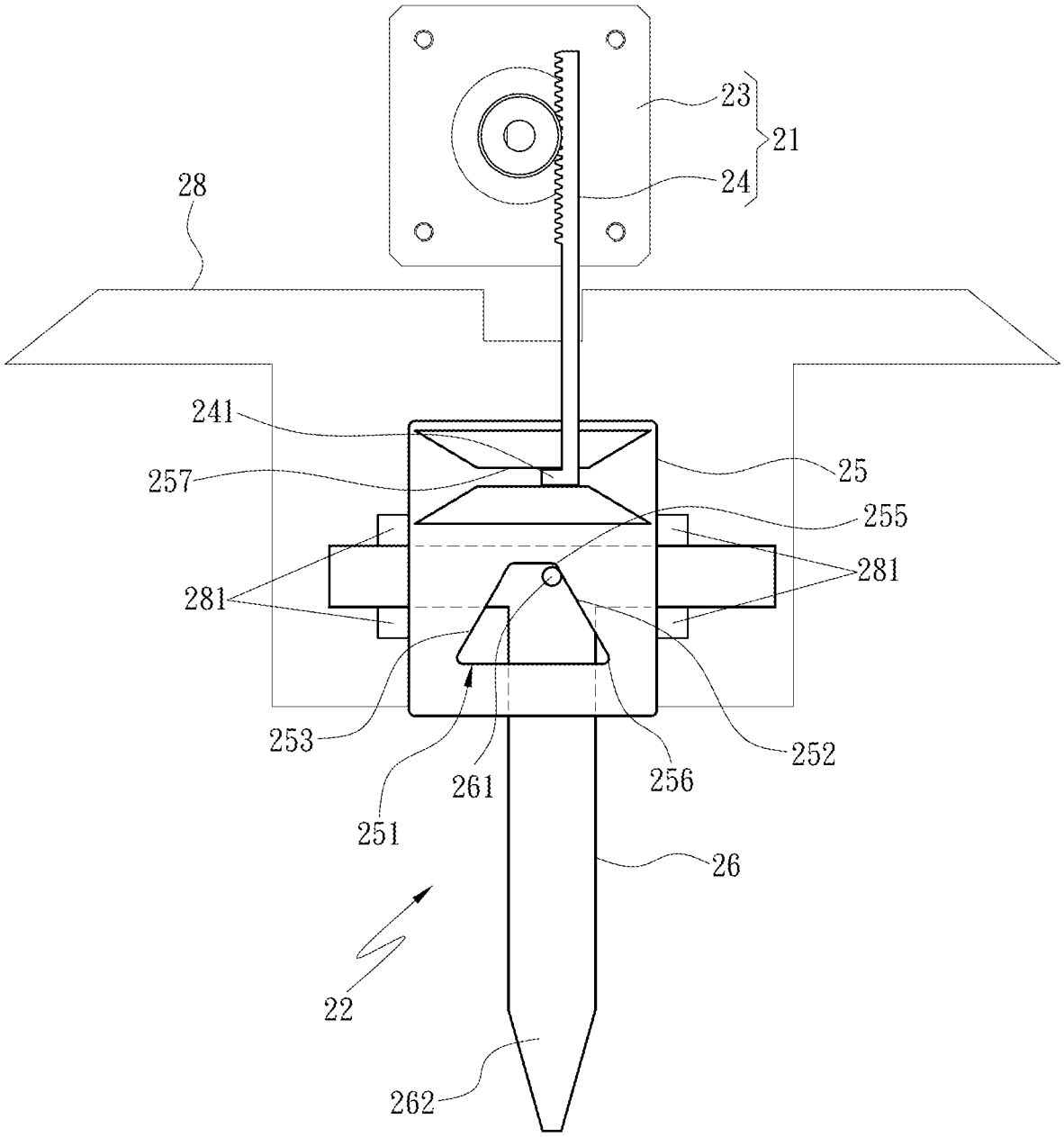
FIG. 2 is a structural schematic diagram (I) of a flat knitting machine yarn feeder in an embodiment of the present invention.
Figure 3:
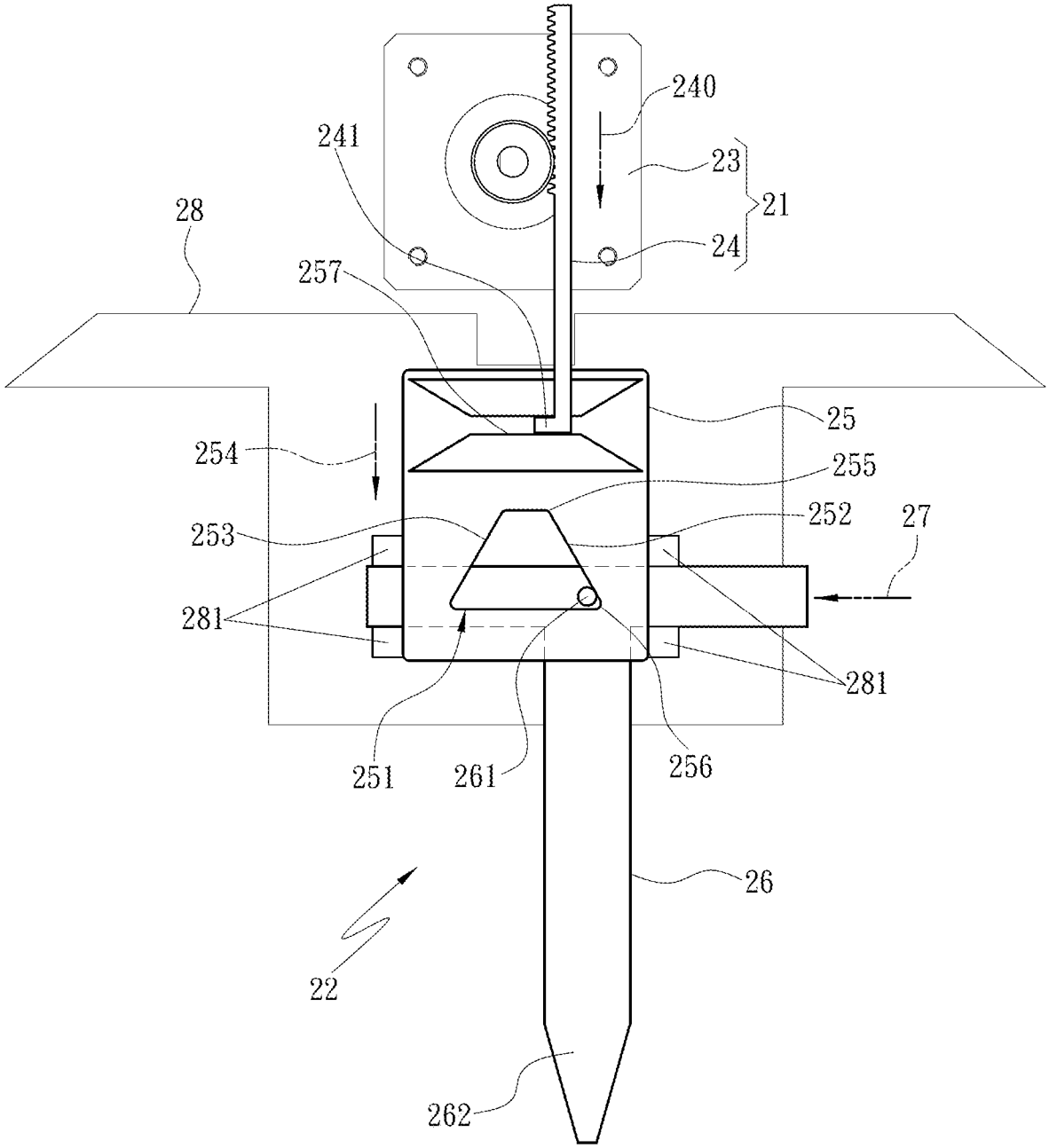
FIG. 3 is a structural schematic diagram (II) of a yarn feeding mechanism in an embodiment of the present invention.
Figure 4:
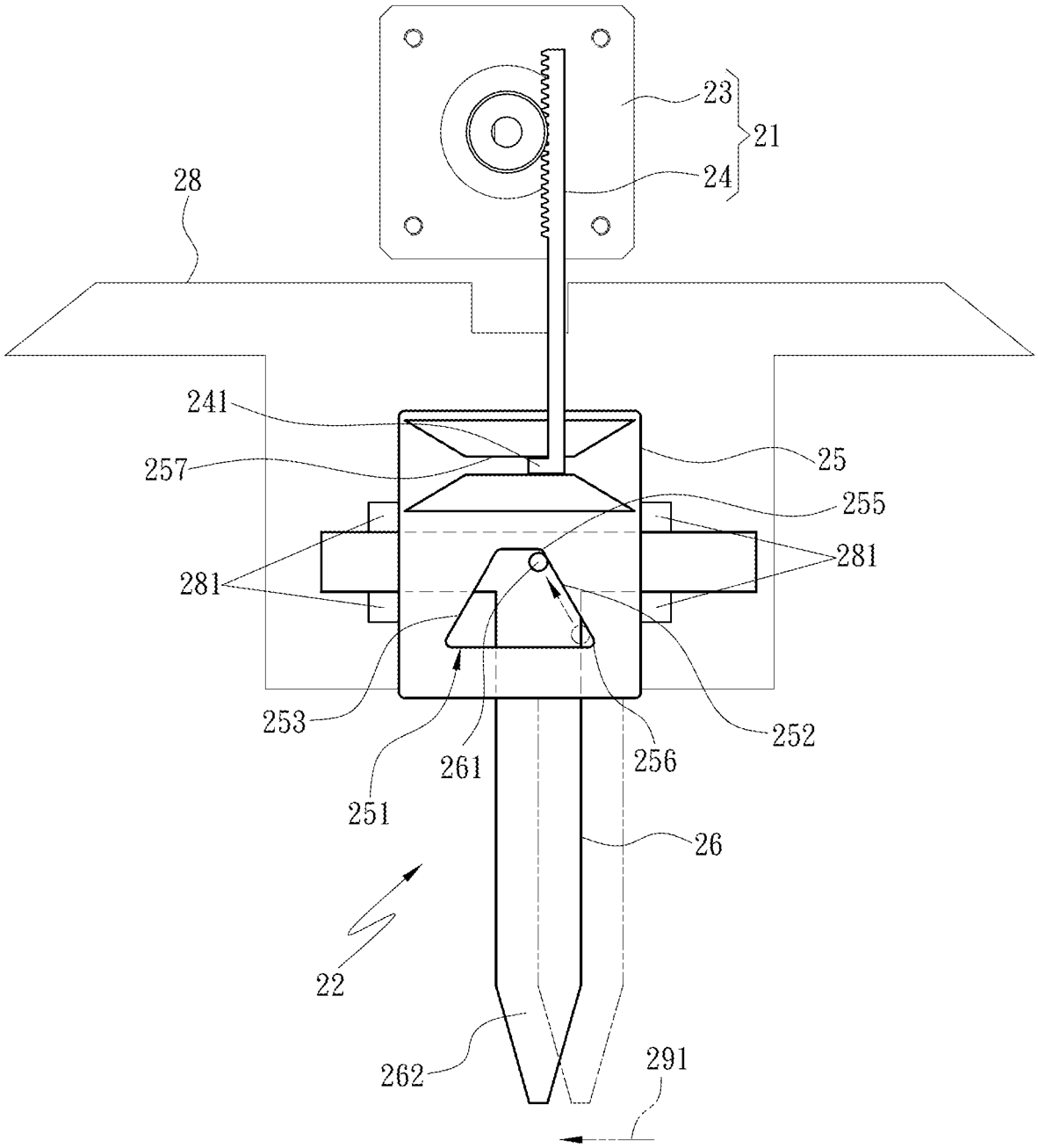
FIG. 4 is a structural implementation schematic diagram of a yarn feeding mechanism in an embodiment of the present invention.

In another aspect, referring to FIGS. 2, 3 and 4, the yarn feeding mechanism 22 comprises a joining plate 25 connected with the driving plate 24 and a yarn feeding arm 26 assembled with the joining plate 25. The joining plate 25 is designed to move along with the driving plate 24. In an embodiment, the driving plate 24 comprises a bump 241 which is disposed at an end and protrudes towards the joining plate 25. The joining plate 25 comprises a supporting rail 257 to provide the bump 241 for disposal. The supporting rail 257 is not required to configure a portion with concave and convex. The supporting rail 257 actually allows the bump 241 to drive the joining plate 25.

Moreover, the joining plate 25 comprises a guide hole 251. The guide hole 251 is not a circular hole. In an embodiment, the guide hole 251 comprises two bevels 252 and 253 which are disposed oppositely. The two bevels 252 and 253 are positioned on a motion track of the flat knitting machine yarn feeder 20. Further, the guide hole 251 may be trapezoidal. The yarn feeding arm 26 comprises a guide column 261 disposed in the guide hole 251, wherein the length of the guide column 261 is set to contact with the guide hole 251 of the joining plate 25, at least. Furthermore, the yarn feeding arm 26 comprises a yarn feeding end 262 facing one of the needle beds 11 (or 12).

Referring to FIGS. 1, 2, 3 and 4, in order to describe the implementation of the flat knitting machine yarn feeder 20 of the present invention in detail, FIG. 3 is used as an initial state of the flat knitting machine yarn feeder 20 and FIG. 4 is used as a regulated state. In the initial state, the driving mechanism 21 accepts the electronic signal and then start to work. Then, the driving plate 24 is driven to make a push stroke 240 as shown in FIG. 3. The driving plate 24 drives the joining plate 25 to make a displacement stroke 254. The displacement stroke 254 is also a one-dimensional motion actually. Further, when the joining plate 25 makes the displacement stroke 254, the guide hole 251 moves along with the joining plate 25 so that the guide column 261 changes the position in the guide hole 251 (as shown in FIG. 4). The yarn feeding arm 26 generates a displacement (in a motion direction 291 shown in FIG. 4) when the guide column 261 changes the position, and then changes the yarn feeding position of the yarn feeding end 262 relative to one of the needle beds 11 (or 12), so as to change the yarn intake position of the flat knitting machine yarn feeder 20.

Referring to FIGS. 3 and 4, when the guide hole 251 comprises the two bevels 252 and 253, the guide column 261 only contacts with one of the two bevels 252 and 253 according to the current motion direction 27 of the flat knitting machine yarn feeder 20. Further, when the guide column 261 comes into contact with one of the two bevels 252 and 253, the guide column 261 is positioned between a vertex 255 and a bottom point 256 of each of the bevels 252 (or 253), or is positioned on the vertex 255 or the bottom point 256. Furthermore, when the guide hole 251 is trapezoidal, the vertex 255 refers to a vertex angle of the trapezoid, and the bottom point 256 refers to one of basic angles of the trapezoid.

Referring to FIGS. 1, 2 and 3, in an embodiment, the yarn feeding mechanism 22 includes a combining element 28 assembled with a yarn feeder guide rod 30. The combining element 28 includes a plurality of limiting columns 281 respectively disposed to correspond to the joining plate 25 and the yarn feeding arm 26 to limit the joining plate 25 and the yarn feeding arm 26 to only make one-dimensional motion. Based on this, the positions of the plurality of limiting columns 281 are configured according to motion needs of the joining plate 25 and the yarn feeding arm 26.

What is claimed is:

1. A flat knitting machine yarn feeder with variable yarn feeding positions, comprising:

a driving mechanism controlled by an electronic signal and comprising a driving plate which is making a push stroke after started; and a yarn feeding mechanism comprising a single joining plate connected with the driving plate and a yarn feeding arm assembled with the joining plate, wherein the joining plate comprises a guide hole, the yarn feeding arm comprises a guide column disposed in the guide hole, the joining plate makes a displacement stroke when the driving plate makes the push stroke, the yarn feeding arm comprises a yarn feeding end facing one of needle beds, the guide column changes a position in the guide hole when the joining plate makes the displacement stroke, and the yarn feeding arm changes a yarn feeding position of the yarn feeding end relative to one of the needle beds when the guide column changes the position, wherein the driving plate comprises a bump that is disposed at an end and protrudes towards the joining plate, the joining plate comprises a supporting rail, and the bump is directly connected to the supporting rail, and wherein the guide hole comprises two bevels that are disposed oppositely and contacted with the guide column, the two bevels are positioned in a motion direction of the flat knitting machine yarn feeder, the yarn feeding position is changed when the guide column changes the position of one of the bevels, and the guide hole is trapezoidal.

2. The flat knitting machine yarn feeder with variable yarn feeding positions of claim 1, wherein the yarn feeding mechanism comprises a combining element assembled with a yarn feeder guide rod, and the combining element comprising a plurality of limiting columns respectively disposed to correspond to the joining plate and the yarn feeding arm to limit the joining plate and the yarn feeding arm to only make one-dimensional motion.

* * * * *